US007608817B2

(12) United States Patent
Flory

(10) Patent No.: US 7,608,817 B2
(45) Date of Patent: Oct. 27, 2009

(54) ADIABATICALLY-TUNED LINEAR ION TRAP WITH FOURIER TRANSFORM MASS SPECTROMETRY WITH REDUCED PACKET COALESCENCE

(75) Inventor: Curt Alan Flory, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 282 days.

(21) Appl. No.: 11/780,667

(22) Filed: Jul. 20, 2007

(65) Prior Publication Data

US 2009/0020694 A1 Jan. 22, 2009

(51) Int. Cl.
*H01J 49/26* (2006.01)

(52) U.S. Cl. ..... 250/282; 250/281; 250/283; 250/286; 250/287

(58) Field of Classification Search ..... 250/281, 250/282, 283, 286, 287, 290, 291, 294, 297
See application file for complete search history.

(56) References Cited

U.S. PATENT DOCUMENTS 6,744,042 B2 6/2004 Zajfman et al.

*Primary Examiner*—David A Vanore
*Assistant Examiner*—Michael Maskell

(57) ABSTRACT

A linear ion trap traps a plurality of charged particles in a charged particle trap including first and second electrode mirrors arranged along an axis at opposite ends of the particle trap, the electrode mirrors being capable, when voltage is applied thereto, of creating respective electric fields configured to reflect charged particles causing oscillation of the particles between the mirrors. The method includes: (a) introducing into the charged particle trap the plurality of charged particles, the particles having a spread in the oscillation time of the particles per oscillation; (b) applying voltage to the electrode mirrors during step (a) to induce a relatively weak self-bunching of the charged particles; and (c) after the plurality of charged particles has been introduced into the charged particle trap, waiting for a time period ΔT and then changing the voltage so as to induce a relatively stronger self-bunching among the charged particles.

22 Claims, 10 Drawing Sheets

ADIABATICALLY-TUNED LINEAR ION TRAP WITH FOURIER TRANSFORM MASS SPECTROMETRY WITH REDUCED PACKET COALESCENCE

BACKGROUND

A variety of different types of mass spectrometers or analyzers are known. These include quadrupole mass analyzers, time of flight (TOF) mass analyzers, ion cyclotron resonators, and ion trap mass spectrometers (IT-MS). One type of mass spectrometer of recent interest is a linear ion trap (LIT) Fourier-transform mass-spectrometry (FT-MS) system.

In an LIT FT-MS system, mono-energetic ions are reflected back and forth between a pair of electrostatic (electrode) mirrors. An inductively coupled pick-up coil records the ion current as a function of time. Fourier analysis of this signal current yields a spectrum of the ion oscillation frequencies, which is directly related to the mass spectrum of the ions in the trap. Useful signal is obtained only when each different ion mass species remains separately and tightly bunched.

Zajfman et al. U.S. Pat. No. 6,744,042, the contents of which are incorporated herein in their entirety, describes such a system in which the dynamics induced by the proper choice of the electrostatic mirror potentials in conjunction with the coulomb repulsion between the constituent ions generates an effective self-bunching force, causing the ions to reside in self-sustaining spatially-limited ion packets that can propagate for long periods of time, allowing high-resolution measurements to be made of the mass spectrum of the trapped ions.

However, an unintentional effect of this self-bunching force for identical ions is that ions that are not of identical mass-to-charge ratio, but are adequately close in both mass and spatial position, may experience a net attractive self-bunching force as well. This can cause inaccuracies in the bunch constituent identities as well as a possible merging of similar but non-identical bunches. These effects, which are referred to herein as Ion Bunch Coalescence (IBC), can limit the accuracy, resolution, and sensitivity of the LIT FT-MS.

What is needed, therefore, is a method of operating a LIT FT-MS system that can reduce or eliminate IBC. What is also needed is an LIT FT-MS system that exhibits reduced IBC.

SUMMARY

In an example embodiment, A linear ion trap traps a plurality of charged particles in a charged particle trap including first and second electrode mirrors arranged along an axis at opposite ends of the particle trap, the electrode mirrors being capable, when voltage is applied thereto, of creating respective electric fields configured to reflect charged particles causing oscillation of the particles between the mirrors. The method includes: (a) introducing into the charged particle trap the plurality of charged particles, the particles having a spread in the oscillation time of the particles per oscillation; (b) applying voltage to the electrode mirrors during step (a) to induce a relatively weak self-bunching of the charged particles; and (c) after the plurality of charged particles has been introduced into the charged particle trap, waiting for a time period ΔT and then changing the voltage so as to induce a relatively stronger self-bunching among the charged particles.

In another example embodiment, a device comprises: first and second electrode mirrors disposed along an axis to define a charged particle trap, the charged particle trap being adapted to have charged particles introduced therein; a charge-sensing element disposed between the first and second electrode mirrors to output a signal based on a net charge from charged particles in a vicinity thereof, and a voltage generator adapted to apply voltage to the first and second electrode mirrors. The voltage generator is adapted to apply voltage to the first and second electrode mirrors to induce a relatively weak self-bunching of the charged particles when the charged particles are initially introduced into the charged particle trap and for a time period ΔT thereafter, and then after the period ΔT to change the voltage applied to the first and second electrode mirrors so as to induce a relatively stronger self-bunching among the charged particles.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparati and methods may be omitted so as to not obscure the description of the example embodiments. Such methods and apparati are clearly within the scope of the present teachings.

Figure 1:
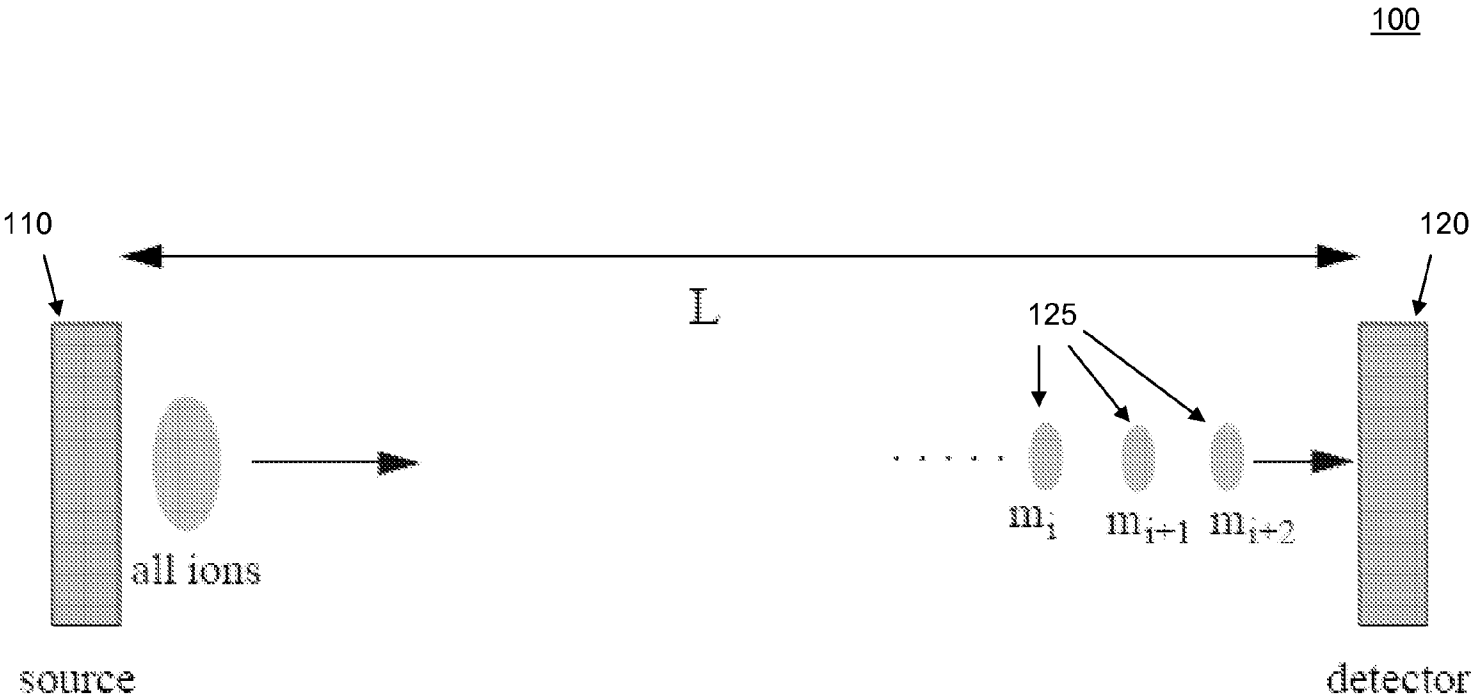
FIG. 1 is a schematic illustration of a time-of-flight mass spectrometer.

Conceptually, one of the simplest methods for determining the mass distribution of a set of charged particles is time of flight (TOF) mass spectrometry (MS). FIG. 1 is a schematic illustration of a time-of-flight mass spectrometer 100 including a source 110 and a detector 120 separated by a distance, L. In this arrangement, a spatially localized cloud of charged particles (e.g., ions) 125 is accelerated in a specified direction by an electric field to a fixed energy per charged particle, $E_0$. Each species of charged particle 125 attains a flight velocity $v_i=(2E_0/m_i)^{1/2}$ unique to its particular mass, $m_i$. The charged particles 125 are allowed to freely propagate over the fixed distance L, and their arrival times are detected and recorded at the end of this flight path. These time-of-flight arrival times uniquely correspond to specific charged particle mass values, and the strength of the detected signal gives information about the abundance of this particular charged particle species. Explicitly, the flight time, T(m) is given by:

$$T(m) = \frac{Lm_0^{1/2}}{(2E_o)^{1/2}} m^{1/2} \tag{1}$$

where $m_0$ is a unit mass of one amu, and m is the charged particle mass in amu. Therefore, the time spacing between a charged particle of mass (m+1) and mass m is given by:

$$\Delta T = T(m+1) - T(m) = \frac{Lm_0^{1/2}}{(2E_o)^{1/2}} \frac{1}{2m^{1/2}} \tag{2}$$

in the limit of m>>1.

For larger m-values, it is seen that the peaks are more closely spaced in time. This would not create a measurement problem if the packets of each charged particle species had zero spatial extent. However, in the actual charged particle formation and acceleration process, the charged particle packet begins with a nonzero spatial extent which is maintained over the flight path, and adjacent mass peaks can overlap for larger masses where the peak separation is not adequate to resolve them. As a result, the mass resolution of the TOF-MS is limited in the high-mass regime.

One solution is to increase the flight path length, L, but this is limited by instrument size constraints.

Figure 2:
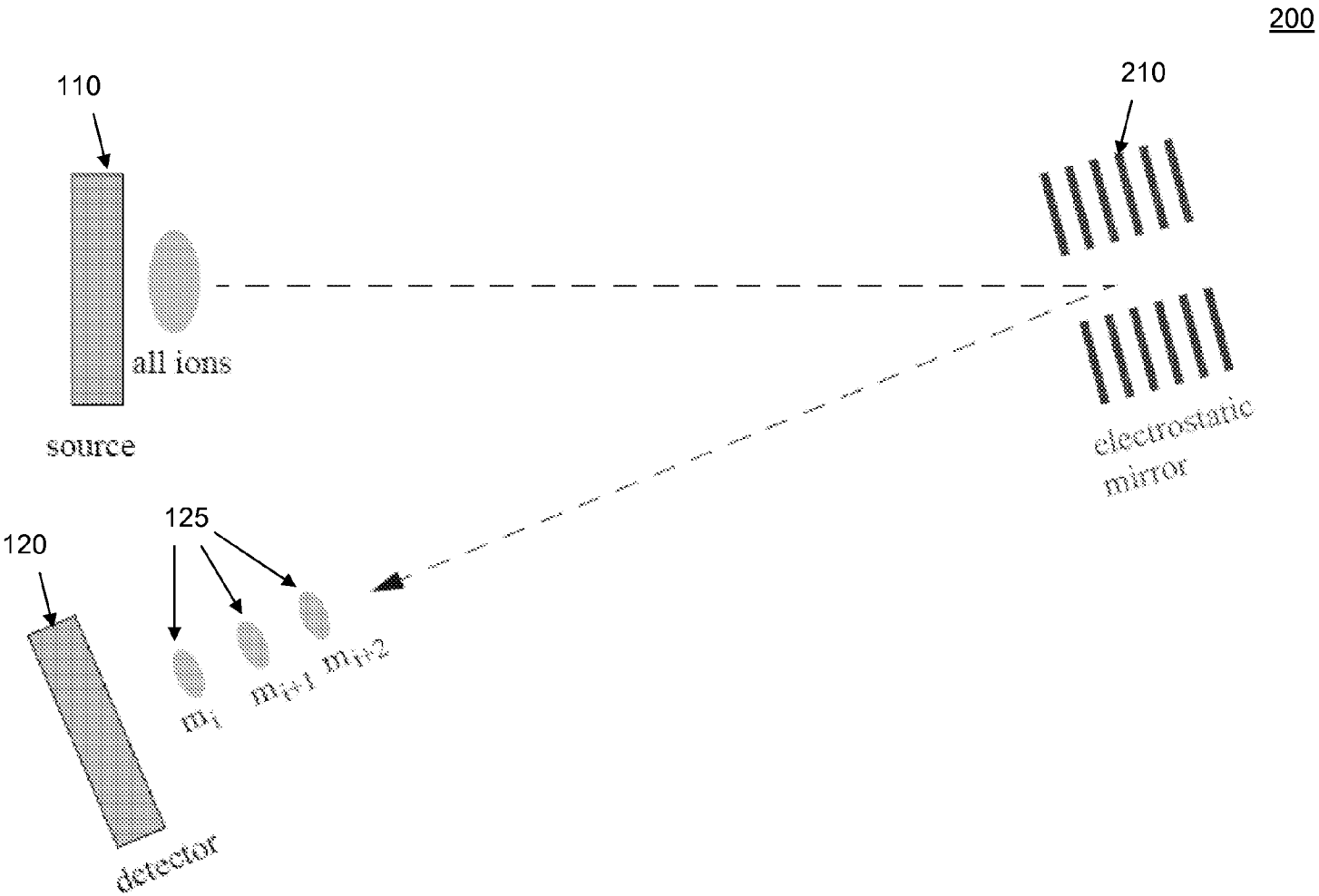
FIG. 2 is a schematic illustration of a time-of-flight mass spectrometer which includes an electrostatic mirror to increase the flight path length and compensate for velocity dispersion.

FIG. 2 is a schematic illustration of a time-of-flight mass spectrometer 200 which includes an electrostatic (electrode) mirror 210 to provide improved performance in a limited-space environment. Electrode mirror 210 is used to reflect the charged particles 125 back, approximately parallel to the initial path, and the charged particles 125 are detected close to the source 110 position, to increase the flight path length and compensate for velocity dispersion. This increase in effective flight path improves mass resolution, but it should be noted that an additional resolution limitation appears as this process is extended. The limitation is due to the fact that the charged particles 125 are not all produced with precisely the same energy, but have a small spread about the specified value. As the charged particles 125 propagate along a greater flight path, this velocity dispersion causes the individual species packets to spatially broaden beyond their initial value, as the more energetic charged particles propagate ahead of their less energetic counterparts.

However, this problem can be addressed by a careful selection of the shape of the profile of electrode mirror 210. Specifically, the more energetic charged particles 125 (which have a shorter flight-time in the field-free regions) penetrate more deeply into electrode mirror 210 before reflecting back. If the mirror potential is adequately "soft," the mirror delay of the more energetic charged particles 125 is adequate to precisely compensate for their smaller propagation time in the field-free regions. This energy-dependent delay of the charged particles 125 in the mirror regions is referred to as "mirror dispersion." Due to the fact that the reflecting fields are electrostatic, this compensation process is mass-independent, and mitigates the problem of packet spreading due to velocity dispersion over longer flight paths.

Given this technique for minimizing the effects of velocity dispersion over long flight paths, it can be seen that mass resolution can be increased even more dramatically by providing a geometry with two electrostatic (electrode) mirrors forming a one-dimensional ion trap.

Figure 3:
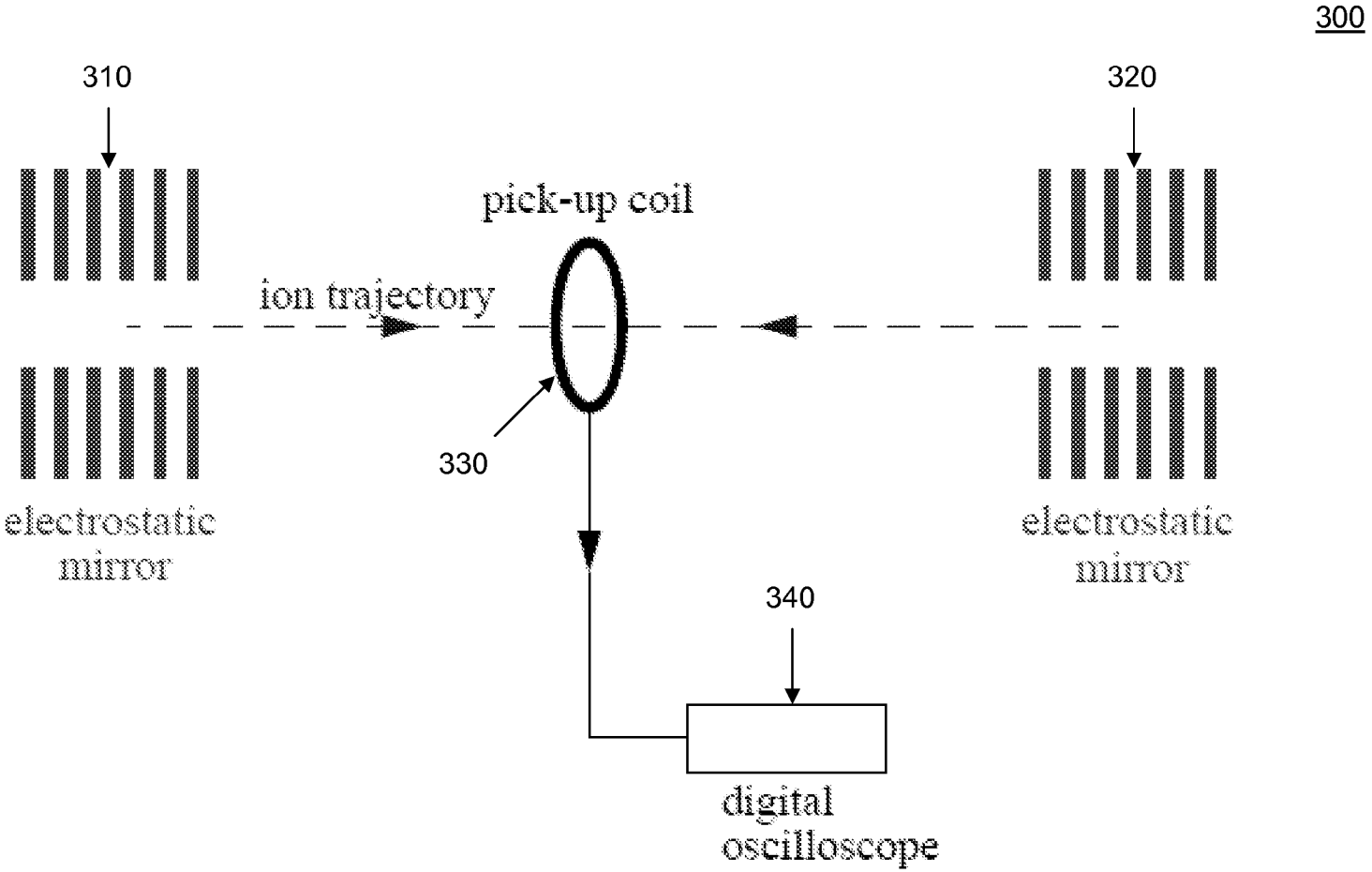
FIG. 3 is a schematic illustration of a one-dimensional linear ion trap with an induction coil used for ion detection.

FIG. 3 is a schematic illustration of a one-dimensional linear ion trap 300 with first and second electrode mirrors 310/320, and an induction coil 330 and digital oscilloscope used for charged particle detection. In particular, FIG. 3 illustrates a linear ion trap (LIT) Fourier transform mass spectrometer (FT-MS) 300.

For this configuration, the charged particles can propagate over an arbitrarily long flight path as they bounce back and forth between the opposing mirror structures 310/320, with the mirror penetration-delay compensating for the initial velocity dispersion of the charged particle packet. The effective flight path length is only limited by "ion lifetime" effects such as charged particles scattering from background molecules, or charged particles escaping the ion trap. It is to be noted that there is no "beginning" and "end" to the flight path, as the path circulates back on itself, and lighter charged particles will tend to "lap" their heavier counterparts over the period of many cycles through the trap.

As a result, a simple measurement of flight time is no longer possible, and one cannot sequence the charged particle masses by relative flight-time delay. Instead, it is possible to measure the frequencies at which the various charged particle mass species make complete propagation cycles between first and second electrode mirrors 310/320 using induction coil 330. The induced signal in induction coil 330 is recorded over time, and then Fourier transformed to find the spectrum of oscillation frequencies, and thus the charged particle masses and abundances.

Figure 4:
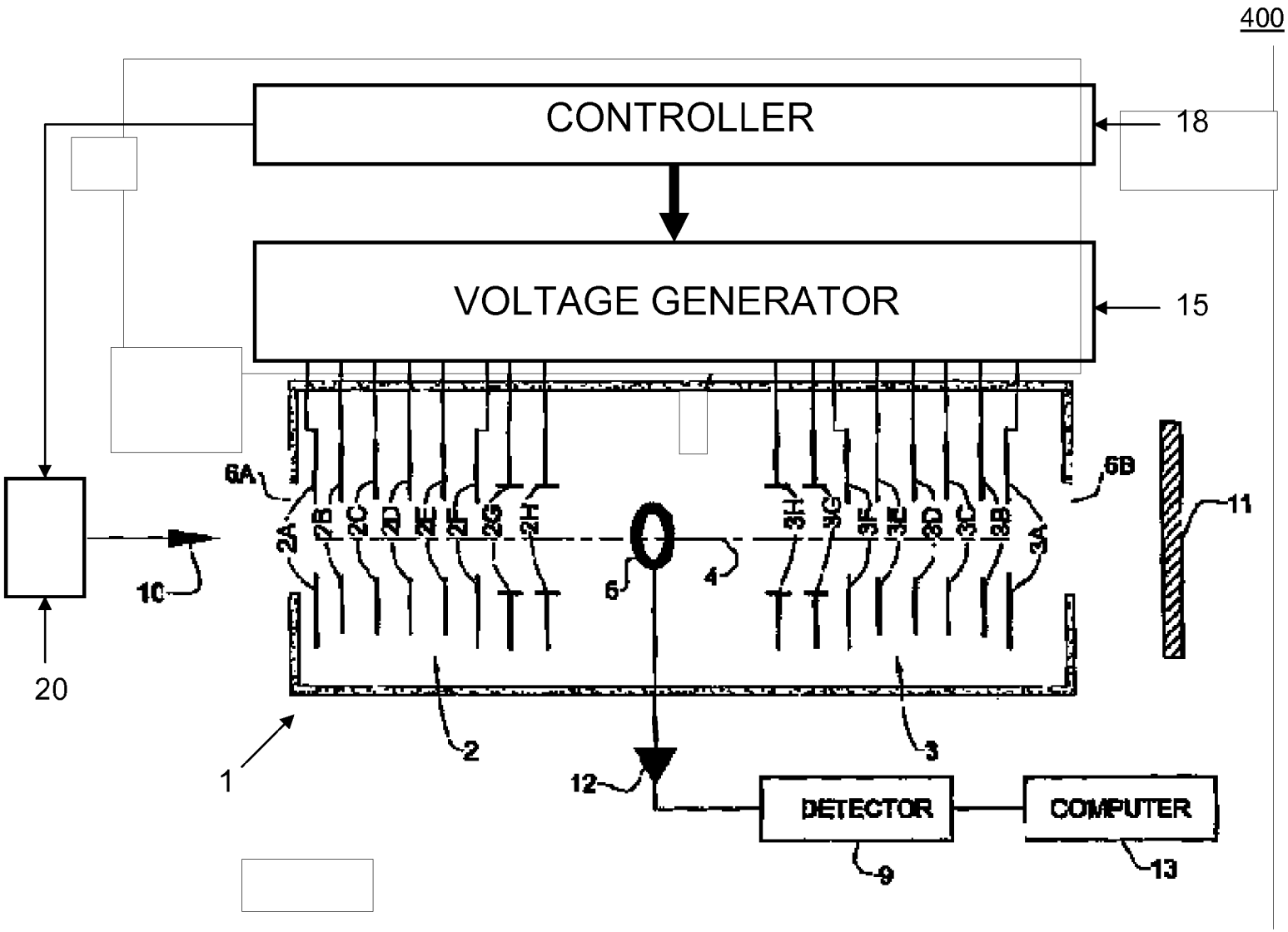
FIG. 4 is a more detailed schematic diagram of one embodiment of a linear ion trap.

FIG. 4 is a more detailed schematic diagram of one embodiment of an LIT FT-MS system 400. System 400 includes ion trap 1, first and second electrode mirrors 2 and 3 having a common axis 4 and arranged in alignment at two extremities thereof. First and second electrode mirrors 2 and 3 have respective apertures 6A and 6B, of which one (6A) constitutes an entrance through which charged particles 10 are to be introduced into ion trap 1 via source 20 along the axis 4. Ion trap 1 also includes a charge-detecting element (e.g., induction coil(s)) 5 situated between first and second electrode mirrors 2 and 3 and a low-noise charge-sensitive amplifier 12 electrically connected to the detecting element 5 to amplify a signal induced by a flux of net charge about detecting element 5. Ion trap 1 further comprises a detector 9, such as a digital oscilloscope or a frequency analyzer, for recording the signal from the amplifier 12, and a computer 13 to further analyze the signal. Outside the trap 1, and facing at least one of the apertures 6A and 6B, is a micro-channel plate detector 11, able to detect impacting particles leaving the trap 1.

Each electrode mirror 2/3 includes a respective set of electrodes 2A-2H, 3A-3H, which are electrically connected to a voltage generator 15, allowing for the application of voltage to the electrodes 2A-2H and 3A-3H and adjustment thereof. Each electrode 2A-2H, 3A-3H is adapted to be maintained at a voltage by the voltage generator 15, rendering the mirrors 2 and 3 capable of creating respective electrostatic fields, the configuration of which is defined by key field parameters. These parameters include the number of electrodes 2A-2H, 3A-3H in each electrode mirror 2/3, the geometrical arrangement of the electrodes 2A-2H, 3A-3H and the voltage applied to the electrodes 2A-2H, 3A-3H.

In the embodiment of FIG. 4, system 400 further includes a controller 18 for controlling voltage generator 15 as described in greater detail below. Also, in this embodiment, controller 18 may control charged particle source 20 to thereby control the introduction of charged particles 10 into ion trap 1.

Figure 5:
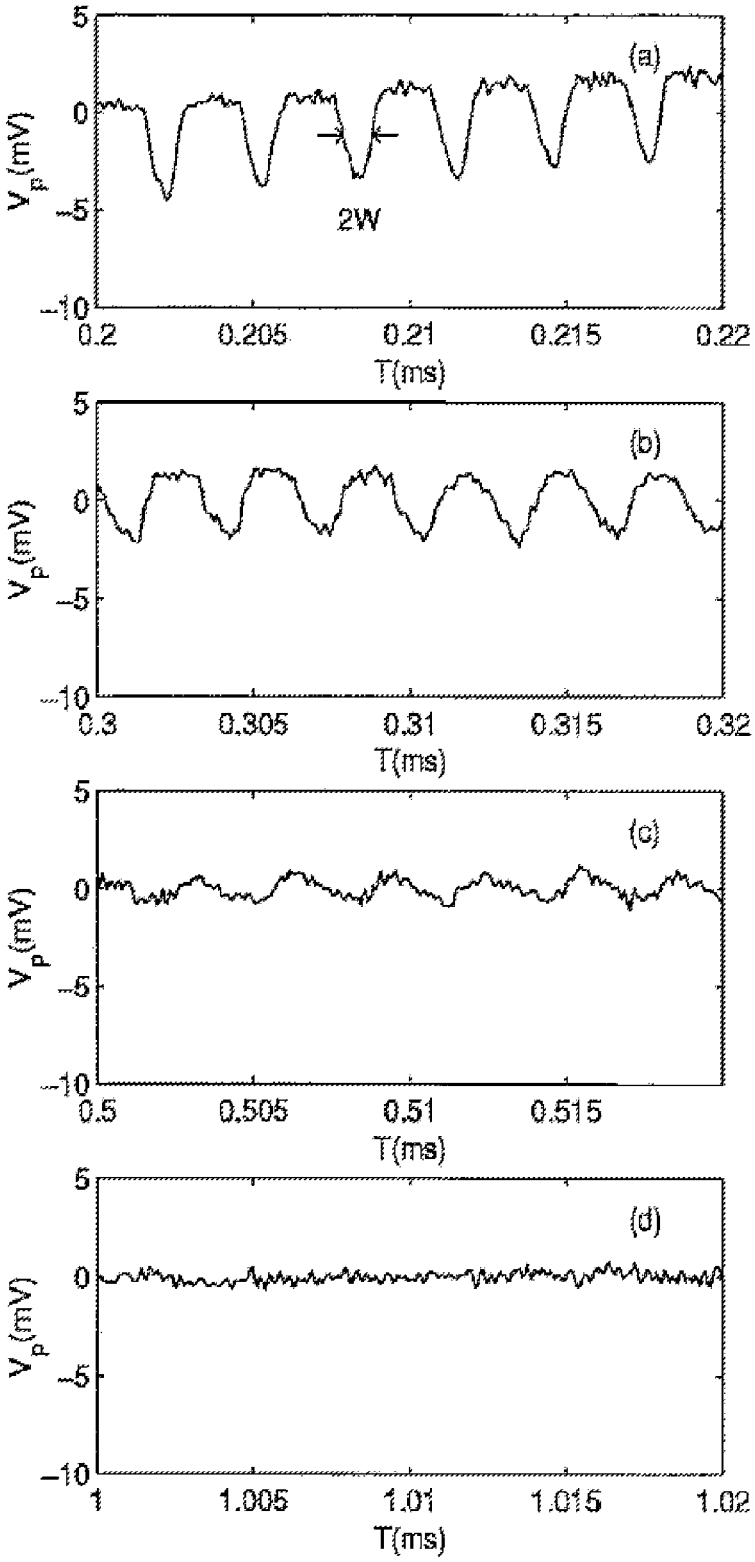
FIG. 5 shows a signal observed with a pick-up electrode for an initially 170-ns wide bunch of $Ar^+$ at 4.2 keV for four time intervals after injection: (a) 0.20-0.22 ms, (b) 0.30-0.32, (c) 0.50-0.52, and (d) 1.00-1.02 ms.

FIG. 5 shows example results for a LIT FT-MS in the case of an injected charged particle pulse comprising a 170-ns wide bunch of $Ar^+$ at 4.2 keV, and the time-dependent voltage generated in the pick-up (induction) coil(s) 5 shows an oscillatory behavior that persists for well over 100 cycles before dissipating away. This dissipation of the pulse, or "debunching" of the charged particle packet, is assumed to be due to three effects: (1) velocity dispersion of the charged particles imperfectly compensated by first and second electrode mirrors, (2) different trajectories in the trap due to lateral motion, and (3) bunch spreading due to Coulomb repulsion between the charged particles in the bunch (thought to be the dominant effect). While an effective path length of over 100 times the nominal single-pass flight path of the instrument would be impressive for a true TOF system, for the FT-MS measurement technique the achieved resolution can be lower than for a comparable single-pass TOF system. The reason is that to distinguish two similar frequencies (masses), one needs many cycles for comparison ($\approx 1/\Delta f$).

Figure 6:
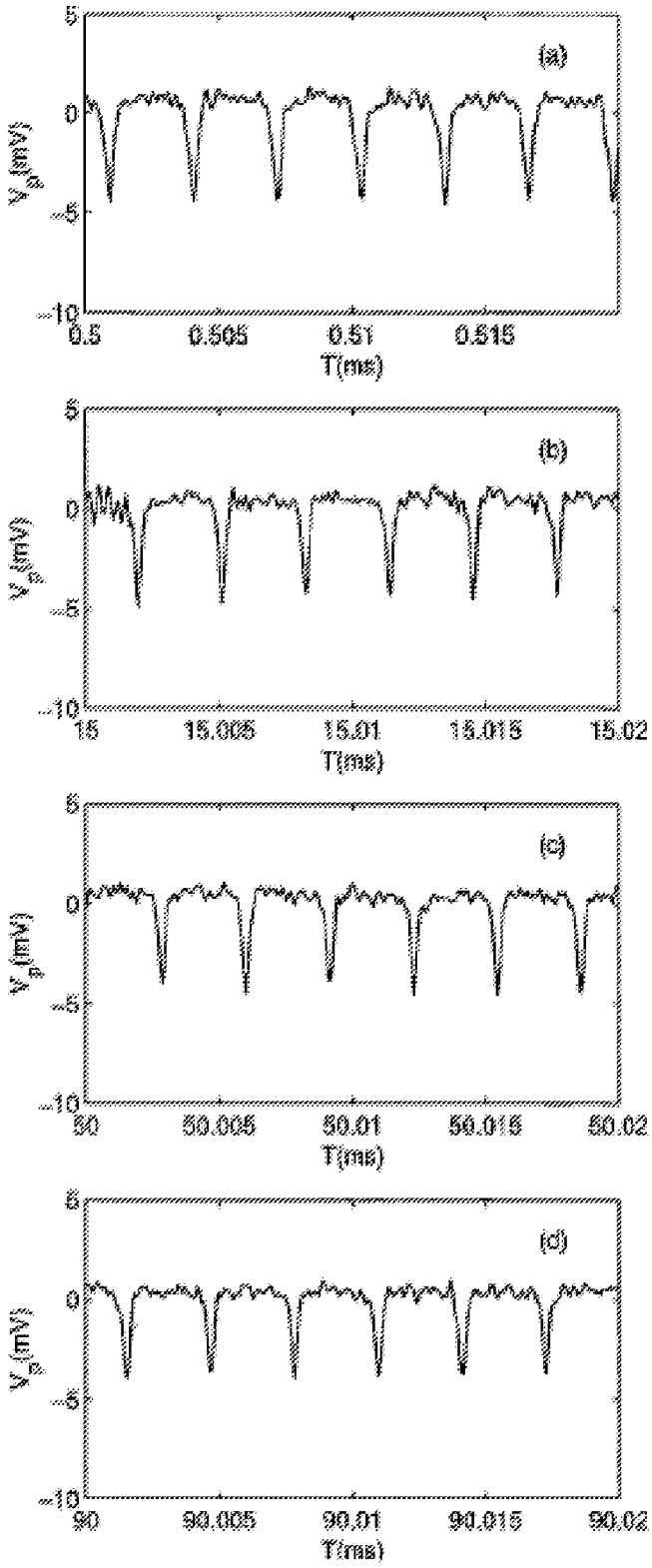
FIG. 6 shows a signal observed with a pick-up electrode for an initially 170-ns wide bunch of $Ar^+$ at 4.2 keV for four time intervals after injection: (a) 0.50-0.52 ms, (b) 15.00-15.02, (c) 50.00-50.02, and (d) 90.00-90.02 ms.

It has been found that for a certain range of electrode mirror potential shapes, the charged particle bunches become self-bunching and self-sustaining, and do not spread over the course of the experiment. The time-dependent signal measured in the pick-up coils, as shown in FIG. 6, are for the same experimental setup shown in FIG. 5, except the mirror potential shapes have been adjusted into the appropriate range for self-bunching. The bunch fidelity is maintained for the full measurement range, which exceeds 30,000 cycles. This basic technology holds tremendous promise for improving resolution in low-cost mass spectrometry.

This self-bunching phenomenon is observed for a range of LIT parameters. The dynamical origin of the effect is an interplay between the previously described mirror dispersion and the coulomb repulsion of the charged particles comprising the bunch, yielding a net self-bunching or self-focusing force.

This surprising result from the dynamical interplay of these two separate effects can be understood in the following intuitive way. Consider a bunch of charged particles of equal mass with a small velocity spread entering the mirror region. Due to kinematics, the faster charged particles will tend to be at the leading edge of the bunch, with the lower velocity charged particles at the trailing edge. Additionally, as a result of the coulomb repulsion between these charged particles, the leading (high velocity) charged particles will tend to be accelerated forward, and the trailing (low velocity) charged particles will tend to be decelerated backward. However, due to the mirror dispersion, the higher velocity charged particles experience increased flight time in the mirror region than the rest of the charged particles, and thus are driven back toward the spatial center of the bunch.

Similarly, the lower velocity charged particles experience decreased flight time in the mirror region than the rest of the charged particles, and thus are driven forward toward the spatial center of the bunch. The final effect is a net focusing or self-bunching of the charged particle bunch. Additionally, the coulomb interactions between the charged particles in the bunch cause a continuous redistribution of energy among the constituent charged particles. While this simple argument does not prove the stability of the self-bunching dynamic, both simulations and experiments definitively do, as discussed below.

It is possible to gain a deeper understanding of the charged particle bunching dynamics using some simple modeling techniques. The dynamics are easily illustrated in a simple one-dimensional idealization of the LIT FT-MS systems shown in FIGS. 3-4.

An attempt to model the dynamics of all of the individual charged particles in a bunch would be problematic due to the sheer number of particles, which could exceed $10^5$ to $10^6$.

Instead, a mean-field approach can be used, where the packet of charged particles is replaced by a sphere of radius uniformly filled with charged particles of the specified mass-to-charge ratio, moving synchronously in the potential field of the LIT. Co-propagating with this sphere of charge is an additional single "test" charged particle of the same mass-to-charge ratio. By analyzing the behavior of the test charged particle as it propagates under the influence of the charged sphere (ion bunch), it can be determined under what conditions the test charge is "bound" or "unbound" to the charged particle bunch.

Figure 7:
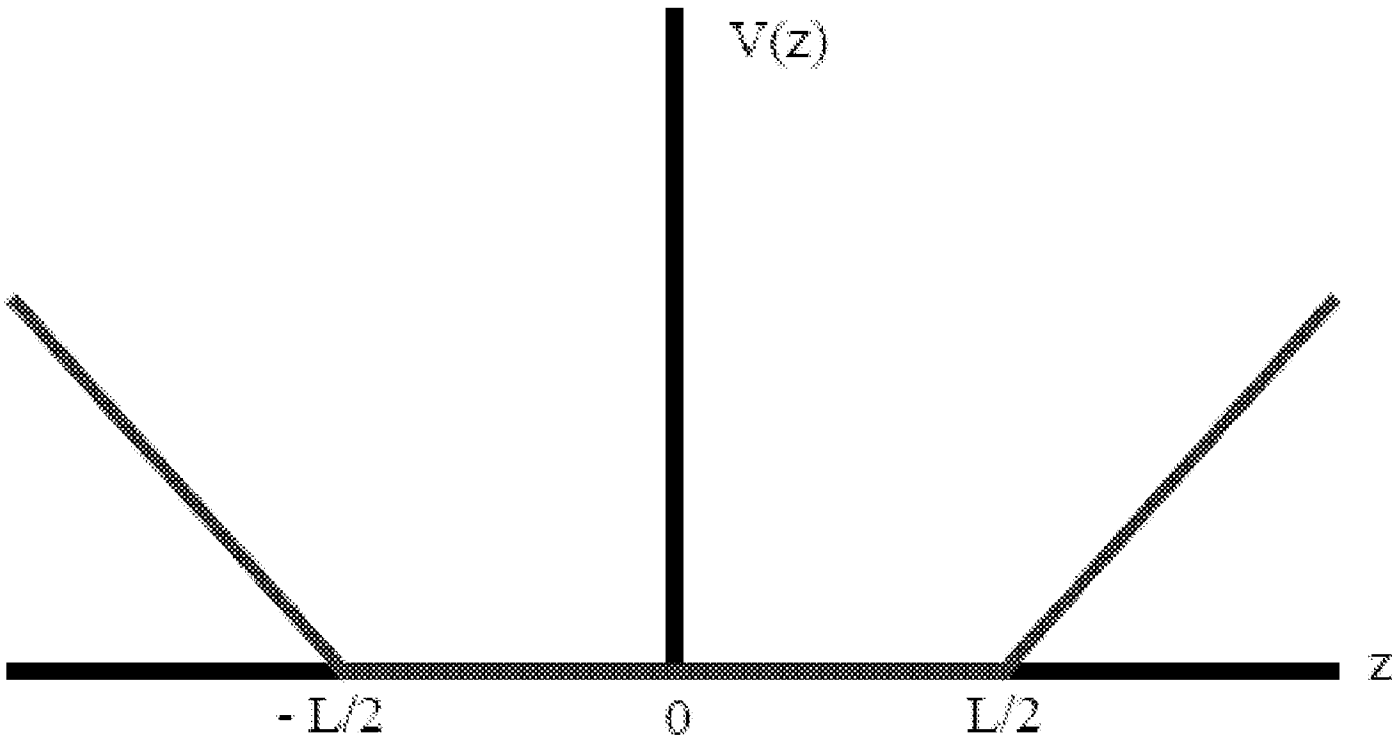
FIG. 7 shows one embodiment of a potential distribution for a linear ion trap.

FIG. 7 illustrates one embodiment of a potential distribution, V(z) along the axis at a distance z from a midpoint between the first and second electrode mirrors for the LIT FT-MS systems shown in FIGS. 3-4.

The specific potential model used to represent the LIT FT-MS system is chosen to have linear mirror potentials as shown in FIG. 7, where:

$$V(z) = \begin{cases} 0 & \text{if } |z| \le L/2 \\ \Im(|z| - L/2) & \text{if } |z| > L/2 \end{cases} \tag{3}$$

For this potential distribution, the oscillation period is given by:

$$T = \frac{2L}{(2E/m)^{1/2}} + \frac{4m}{\Im}\left(\frac{2E}{m}\right)^{1/2} \tag{4}$$

To quantify the effects of the mirror, the fractional change in the oscillation period as a function of the charged particle energy is calculated to be:

$$\frac{1}{T}\frac{dT}{dE} = \frac{\left(E - \frac{\Im L}{4}\right)}{2E\left(E + \frac{\Im L}{4}\right)} \tag{5}$$

The dimensionless mirror dispersion parameter is defined to be:

$$\alpha = \frac{2E}{T}\frac{dT}{dE} = \frac{\left(E - \frac{\Im L}{4}\right)}{\left(E + \frac{\Im L}{4}\right)} \tag{6}$$

From this parameterization, the mirror fields can be written in terms of the mirror dispersion:

$$\Im = \frac{4E(1-\alpha)}{L(1+\alpha)} \text{ or } \Im = \frac{K(1-\alpha)}{(1+\alpha)} \tag{7}$$

where K is a selected value corresponding to 4E/L.

From equation (7), it can be seen that for physical fields, $-1<\alpha<1$. It is also noted that $\alpha=0$ corresponds to the previously described "velocity compensating mirror," where the propagation time is insensitive to the charged particle energy. Additionally, $\alpha>0$ corresponds to a "hard" mirror (relative to the "velocity compensating mirror"), and $\alpha<0$ corresponds to "softer" mirror potentials (i.e. higher energies undergo greater time delays in the mirror potential).

This simple model of the co-propagating charged sphere (ion bunch) and individual test charged particle has been analyzed for a range of parameters in order to understand the self-bunching phenomenon.

Figure 8A:
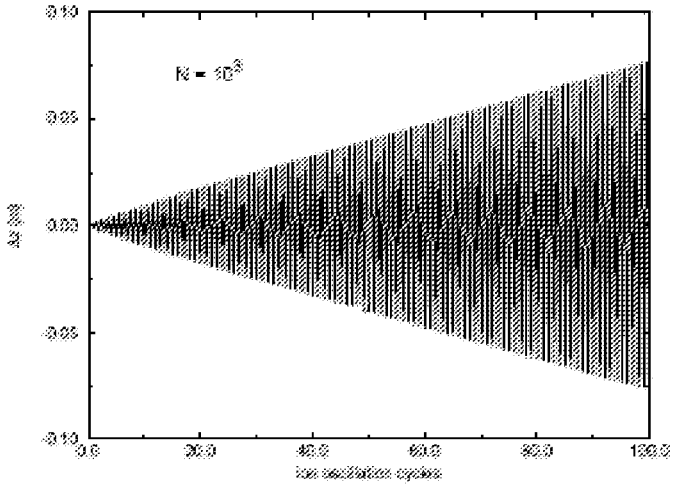
FIG. 8 shows the separation between a test ion and a charged sphere as a function of time for three different values of charge for the charged sphere.
Figure 8B:
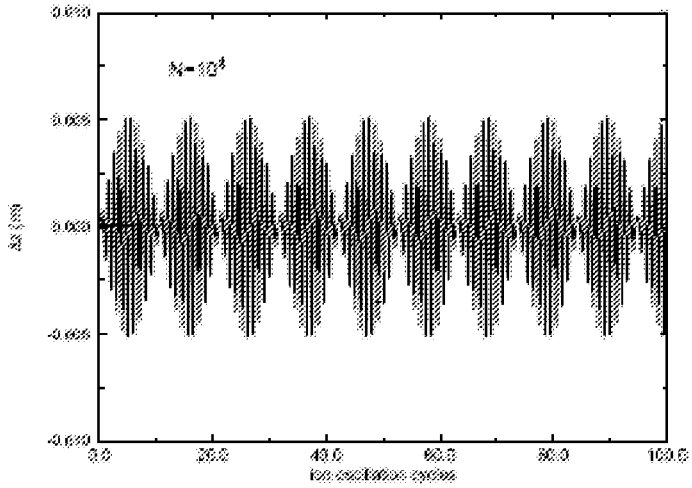
Figure 8C:
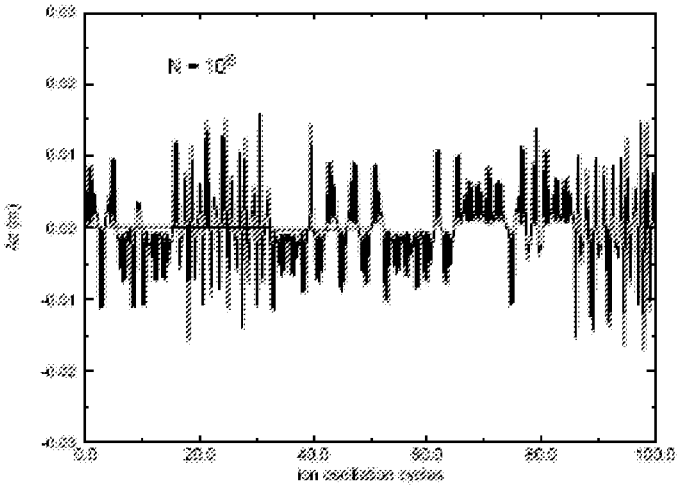

The primary parameters varied are the number of charged particles in the bunch, N, and the strength of the confining mirrors, given by $\alpha$. The quantity that is computed and stored as the system propagates is the spatial separation between the charged sphere and the individual test charged particle. Qualitatively, it is found that for $\alpha<0$ the separation between the sphere and individual charged particle linearly diverges, and there is no net attractive force between them. However, for $\alpha>0$, the position of the test charged particle closely tracks the position of the large charged sphere, as long as N is adequately large (i.e. that the coulomb repulsion effects are adequate to contribute to the dynamics generating a net attractive interaction). FIGS. 8*a-c* show plots of the separation between the test charged particle and the sphere for $\alpha=0.5$, L=30 cm, E=4.2 kV, and m=40 amu, as a function of time for three different values of N. It is also assumed that the initial energy-per-ion of the test charged particle is greater than that of the charged sphere by 10 eV. In FIG. 8*a*, the charged sphere has $N=10^3$ charged particles, and the relative positions of the test charge and sphere linearly diverge with time in accordance with the assumed initial energy-per-ion difference, and no bunching/tracking dynamic is observed. FIG. 8*b* shows the relative position as a function of time for $N=10^4$ charged particles, and the test charged particle clearly tracks and oscillates around the position of the charged sphere in an approximately harmonic fashion, unambiguously demonstrating a net-bunching force. FIG. 8*c* shows the relative position as a function of time for $N=10^5$ charged particles, and the test charged particle clearly tracks and oscillates around the position of the charged sphere, however the net effective restoring force appears to be stronger and more unstable than that of FIG. 8*b*.

Similar plots to those of FIGS. 8*a-c* verify the previous general statements about the dynamics of the self-bunching phenomenon. In fact, for the parameters specified in that case, bunching is observed for values of $0<\alpha<0.9$.

It is desirable to gain some information regarding the relative strengths of the trapping forces for the different choices of $\alpha$, the mirror dispersion parameter. One way to do this is to look at plots like that shown in FIG. 8*b*, where the trapping potential is clearly harmonic, as a function of $\alpha$. For a harmonic potential, the oscillation frequency is proportional to the square root of the "effective spring constant of the restoring force." Thus, by looking at the oscillation frequency of the test charged particle about the charged sphere as a function of $\alpha$, information is gained about the strength of the effective self-bunching potential.

Figure 9:
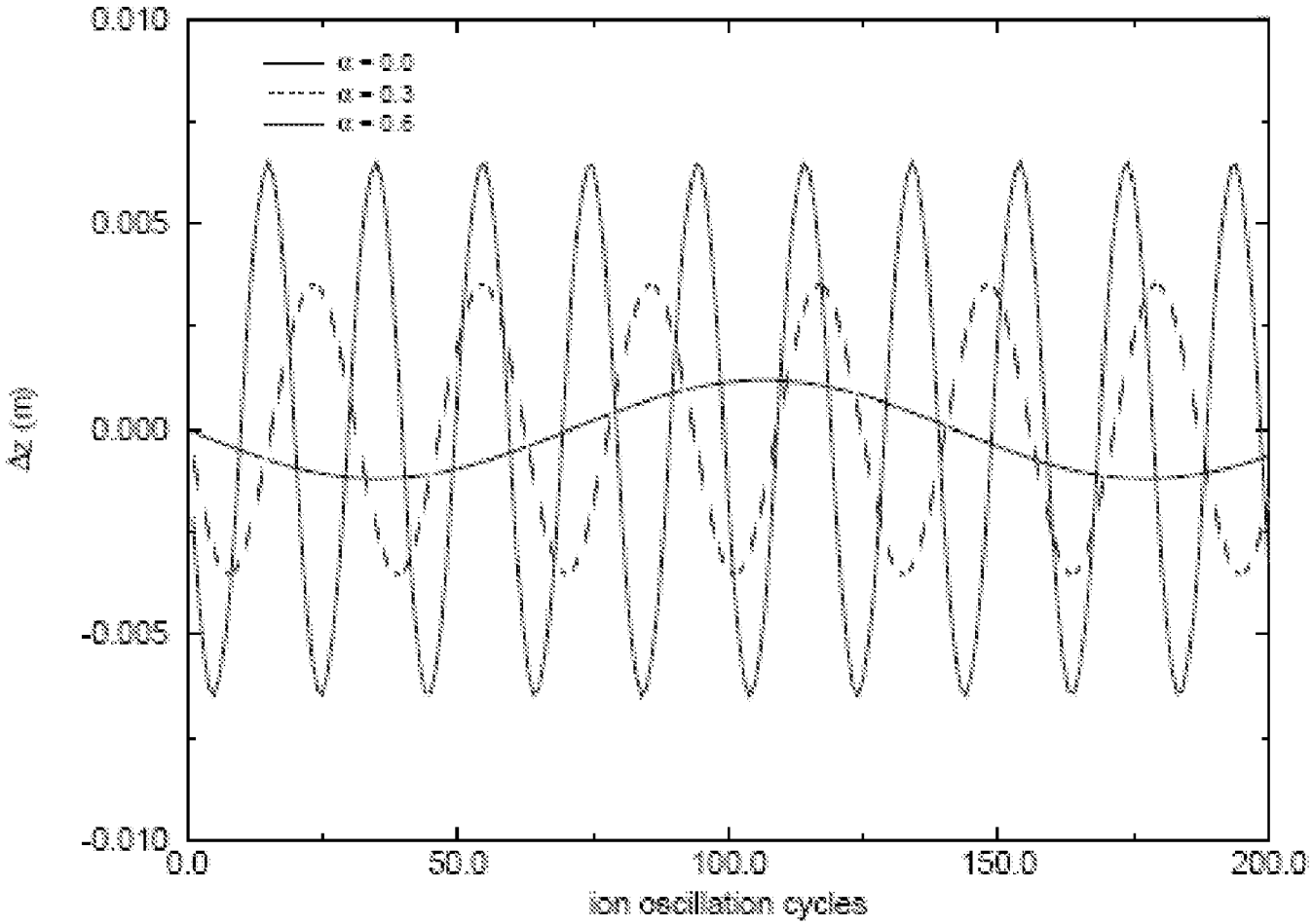
FIG. 9 shows the separation between a test ion and a charged sphere as a function of time for three different values of mirror potential.

FIG. 9 shows plots of the separation between the test charged particle and charged sphere as a function of time for the same parameters as FIG. 8*b*, but for values of $\alpha=0.0$, 0.3 and 0.6 respectively. It is clearly seen that the self-bunching effective-potential strength increases dramatically with increasing $\alpha$, and that the bunch is very weakly bound for $\alpha=0$.

It has now been demonstrated experimentally and theoretically that identical charged particles can propagate in a self-bunching and self-sustaining spatially-localized charged particle packet in a linear ion trap, provided that the electrode mirror fields have the proper shape, and there is an adequate number of individual charged particles comprising the packet. This property can be exploited for mass spectrometry purposes, utilizing the long packet lifetime to accurately measure the oscillation frequency in an LIT FT-MS system, and thus accurately determine the masses of the constituent charged particles.

As explained above in the background section, an unintended and undesirable effect of this self-generated self-bunching force for identical charged particles is that charged particles that are not of identical mass-to-charge ratio, but are adequately close, may experience a net attractive self-bunching force as well. In this case, a large bunch of one particular mass may attract and trap some charged particles from an adjacent bunch with a similar mass, causing errors in the determination of the relative abundances of the different mass types. By a similar mechanism, a larger bunch could completely "swallow up" an adjacent similar smaller bunch, with negative impact on the spectrometer sensitivity. In an analogous way, two adjacent and similar size bunches could merge or coalesce, which would destroy the instrument resolution advantages targeted with the self-bunching phenomenon. These deleterious effects are referred to herein as Ion Bunch Coalescence (IBC).

To study IBC, the model system described above is extended to include an additional uniform sphere of charged particles of mass-to-charge ratio different from that of the first sphere. The relative spatial positions between the test charged particle and the two charged spheres are recorded as they co-propagate through the model of the LIT FT-MS system. For specificity it is assumed that the test charged particle is of mass m, the first charged sphere has $N_1$ constituent charged particles of mass m, and the second charged sphere has $N_2$ constituent charged particles of mass (m+1), where m is in amu.

Ideally, the test charged particle would bind to the first charged sphere if there were no effects of IBC. Indeed, for all cases examined in the model where the masses were chosen to be less than several hundred amu, the test charged particle binds exclusively to the charged sphere with a mass-to-charge ratio identical to its own.

However, when the masses are over 1000 amu or more, the two charged spheres compete to bind the test charge. It is intuitively reasonable that the effects of IBC would be most dramatic at higher masses, as the fractional difference between m and (m+1) decreases with increasing m, and the more similar velocities would allow the previously described self-bunching dynamics to occur between "approximately" identical charged particles. This binding of the test charged particle to a charged sphere with a mismatched mass-to-charge ratio is most dramatically illustrated in the following way. A simulation is run for a test charged particle of mass-to-charge ratio of 4000 amu, a first charged sphere with $N_1=10^4$ and mass-to-charge ratio of 4000 amu, and a second charged sphere with $N_2=10^4$ and mass-to-charge ratio of 4001 amu. The initial conditions specify the position of the first charged sphere and test charged particle to be behind (trailing) the second charged sphere in their motion in the LIT. The test charged particle is initially bound to the first charged sphere. Due to the fact that the first charged sphere has a lower mass than the second charged sphere, it has a larger velocity (as they both have the same energy) and will overtake and pass the second charged sphere.

Figure 10:
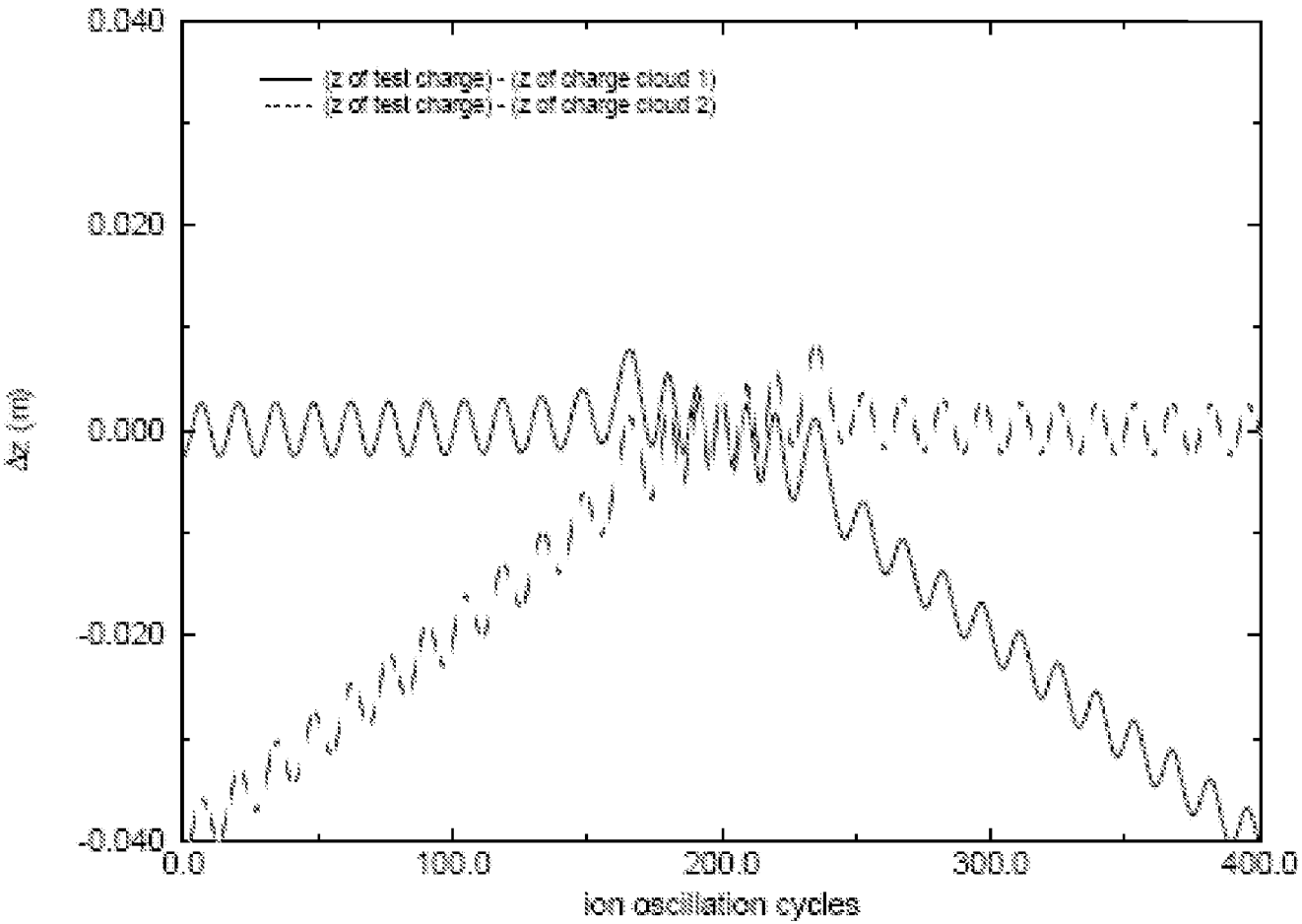
FIG. 10 plots the distance between a test ion and first and second charged spheres as a function of time, where the test ion is pulled from the first charged sphere and then bound to the second charged sphere.

FIG. 10 shows a typical plot of the distances of the test charged particle to the first and second charged spheres as a function of time. It is clearly seen that as the first charged sphere passes through the second charged sphere, the test charged particle is torn from its bound trajectory around the first sphere, and moves to a bound trajectory around the second sphere. If the trap parameters are kept fixed, and the initial conditions (velocities and relative positions) are varied, it is found that the test charged particle is stolen by the second charged sphere about 50% of the time.

This misappropriation of a charged particle by a charged particle bunch of different species (mass-to-charge ratio) is clearly illustrated in FIG. 10. It is demonstrated for a situation where the lower-mass bunch is catching the higher-mass bunch from behind. While this situation does occur in the LIT configuration, it only occurs after many oscillations of the charged particles in the trap, when the faster (lower-mass) charged particles have had adequate time to "lap" their more massive and slower counterparts.

A more serious situation of misappropriation of charged particles into the "wrong" bunch occurs during the process of initially injecting the charged particles into the Linear Ion Trap. The measurement process in a LIT FT-MS system is initiated when a short pulse of charged particles is injected into the trap along its axis, where this mono-energetic pulse consists of all of the charged particles that must be identified. At the moment of injection, the charged particles have not had sufficient drift time to separate according to mass (velocity), and all mass species occupy overlapping spatial regions. It is during these first periods of oscillation in the LIT that the charged particles are most susceptible to being attracted to a charged particle bunch of the wrong species.

To study these effects, simulations were performed for the following situation. The system consists of a test charged particle of mass-to-charge ratio of 4000 amu, a first charged sphere with $N_1=10^4$ and mass-to-charge ratio of 4000 amu, and a second charged sphere with $N_2=10^4$ and mass-to-charge ratio of 4001 amu. The initial conditions specify the positions of the first charged sphere and the second charged sphere to be coincident. A statistically significant number of runs are performed where the initial position and velocity of the test charged particle are randomly selected from a distribution of values close to those specified for the charged spheres. After the trajectory equations have been integrated through enough oscillation cycles of the charged spheres to allow them to separate sufficiently (due to their velocity difference), it is determined which charged sphere (if any) has bound the test charged particle. It is found, as before, that trapping/bunching only occurs for $0<\alpha<0.9$.

For $\alpha>0$, the test charged particle ends up being trapped by the first charged sphere a little more than 50% of the time, and is trapped by the second charged sphere a little less than 50% of the time. For the case of $\alpha=0$, the situation is a bit more complicated. The self-generated trapping effects are relatively weak in this case. The test charged particle roughly tracks the trajectory of the first charged sphere (which has the same mass-to-charge ratio), and is weakly bound to it, approximately 50% of the time. In the cases where it is not bound to the first charged sphere, it is usually thrown-off into a trajectory bound to neither sphere by the weakly competing dynamics of the two charged spheres at the initial stages of propagation.

These simulations, while not making predictions about the exact efficiencies of accurate self-bunching of same-species charged particles, do give a strong indication that significant charged particle misidentification will occur due to these effects. These IBC effects are a significant concern and should cause severe limitations in the operation of LIT FT-MS, especially for higher mass charged particle identification. It is the mitigation of these deleterious IBC effects that are provided by the present invention.

So it has been established that IBC is a potential problem in LIT FT-MS, limiting resolution, sensitivity, and accuracy, especially for large masses. Also, it has been established that the greatest effect occurs immediately after charged particle injection, when all of the charged particle species occupy the same spatial region.

Further, it has been established that the effects are most harmful for strong bunch self-focusing, when $0<\alpha<0.9$. For $\alpha=0$, each species is weakly bound to identical charged particles, with no apparent misappropriation of non-identical charged particles by a co-propagating bunch.

With this understanding of the dynamics contributing to IBC, a solution is now described for mitigating the deleterious effects described above during the operation of an LIT FT-MS system.

In one embodiment, LIT FT-MS system 400 is adapted to change the electrode mirror potentials from being fixed in time, to having a specified time-dependence carefully constructed to minimize the effects of IBC.

In one specific embodiment, voltage generator 15 (e.g., under control of controller 18) is adapted to apply voltage to first and second electrode mirrors 2/3 such that the potential gradient is selected to have $\alpha=0$ during the charged particle injection process, and for a fixed amount of time, $\Delta T$, after injection, to provide a relatively weak self-bunching among the charged particles. During this "initial drift time," the charged particles experience only a very weak self-bunching force with very minimal IBC, as described above for the $\alpha=0$ mirror fields. During this time, the different masses become spatially separated due to their different average velocities for the mono-energetic mixture of charged particles.

After a sufficient "initial drift time" $\Delta T$ with $\alpha=0$, the different charged particle species are adequately separated in space, allowing the tuning of the mirror fields (increase $\alpha$, or decrease the potential gradient) to slowly increase the self-bunching interactions without generating significant IBC. At this point, voltage generator 15 (e.g., under control of controller 18) changes the voltage applied to first and second electrode mirrors 2/3 to raise $\alpha$ and thereby provide a relatively stronger self-bunching among the charged particles. Once $\alpha$ is raised to the desired level to achieve an adequate self-bunching dynamic, this desired level of $\alpha$ is held fixed, and mass-determining data can now be taken as the charged particle bunches propagate as self-sustaining sharply-focused groupings of identical charged particles.

In such an embodiment, data measurements are only taken once $\alpha$ is held fixed, as charged particle oscillation times depend upon the value of $\alpha$.

Accordingly, in one embodiment, specifications for the time-dependent mirror fields, parameterized by $\alpha$, are as follows.

First, the weakly self-focusing field defined by $\alpha=0$ should be maintained for a time $\Delta T$ long enough for the different-mass charged particles of interest to gain adequate spatial separation, due to their different drift velocities. Assuming the initial spatial spread of the injected charged particle packet to be approximately $\Delta z$, it is straightforward to show that the required time, $T_0$ allow charged particles of mass m and (m+1) to separate by a distance equal to $\Delta z$, is given by:

$$T_0 = \frac{\Delta z}{v(m) - v(m+1)} \tag{8}$$

giving the result for large m:

$$T_0 \cong \frac{2\Delta z m^{3/2}}{(2E/m_{amu})^{1/2}} \tag{9}$$

So $\Delta T$ should be chosen to be $\geqq T_0$ as specified above.

Second, in a beneficial embodiment, the fields should be adjusted to their desired value in a continuously linear fashion. If they're not, it may introduce different energy shifts to different mass charged particles. This is seen in the following way. As the mirror potentials are lowered to increase $\alpha$, a charged particle will have its kinetic energy reduced only for the period of time that it resides in the mirror region. Each charged particle species spends a fraction of its time in the mirror regions given by:

$$frac = \frac{\frac{4mv}{\mathfrak{I}}}{\frac{2L}{v} + \frac{4mv}{\mathfrak{I}}} \tag{10}$$

Plugging in the expression for the velocity in terms of the energy and charged particle mass, all of the mass-dependence in this expression cancels, yielding:

$$frac = \frac{\frac{4(2E)^{1/2}}{\mathfrak{I}}}{\frac{2L}{(2E)^{1/2}} + \frac{4(2E)^{1/2}}{\mathfrak{I}}} \tag{11}$$

Due to this mass independence, every charged particle species spends the same fraction of the field-ramping-time, $T_0$, in the mirror regions. However, due to the different path trajectories of the different species, the specific periods of time that each species spends in the mirror regions are different. If the fields are changing at a constant rate (i.e. a linear ramp), all charged particle species will experience the same energy shift because they are all in the mirror regions for the same fraction of the total ramping time. Therefore, the continuous linear ramped field introduces no energy dispersion to the charged particles in LIT FT-MS 400.

Third, the fields should be adjusted slowly on the time scale of the slowest charged particle oscillation in the LIT (i.e. oscillation time of the heaviest charged particle of interest). This can be understood in the following way. Although each charged particle species spends the same (average) fraction of its time in the mirror regions, different species enter and exit these regions at different times. Thus, if the ramping fields are changing during a time period corresponding to N cycles of oscillation of the slowest charged particle, it is possible that in the worst case scenario this charged particle species experienced the changing mirror fields for a time corresponding to some time from N−1 to N+1 cycles, depending upon the start and stop times of the ramp fields with respect to the first entry and last exit of this slowest moving charged particle. Therefore, to have an upper limit for the energy spread induced by the changing mirror potentials equal to or less than p % of the total average energy shift of all the charged particles, the potentials should be changed (ramped) over a time period on the order of many (e.g., 100/p) cycles of the heaviest charged particle in the LIT (e.g. a ramp period of 100 cycles gives a maximum induced energy spread of 1%). In a beneficial arrangement, the voltage applied to the electrode mirrors 2/3 by voltage generator 15 adiabatically tunes the potential field in the LIT.

If these conditions on the time-dependence of the mirror potential ramp are satisfied, the effects of IBC can be greatly minimized.

To illustrate how this would work in a practical system, example simulations have been performed. For the sample results quoted here, it is assumed that the field-free region of the trap has the dimension L=20 cm, charged sphere-1 has m=4000 amu, and $N_1=10^4$, charged sphere-2 has m=4001 amu, and $N_2=10^4$, both charge spheres have a field-free region radius of 3.6 mm, and both have the same starting position. The test charged particle has m=4000 amu, an initial energy randomly selected in a 1 eV range about the energy of the charged spheres, and an initial position randomly distributed over a radius of 3.6. mm about the initial position of the charged spheres. Each simulation result quoted is an average over 900 separate runs, where each run has a different set of initial conditions for the test charged particle.

For comparison purposes, we first compute the fraction of the time that the test charged particle binds to the first charged sphere, and the fraction of the time that it binds to the second charged sphere, for fixed mirror fields. When the simulations were performed for a chosen value of the mirror potentials such that $0<\alpha<0.9$, roughly 50% of the time the test charged particle was tightly bound to charged sphere-1, and the other 50% of the time it was tightly bound to charged sphere-2. For the specific case of $\alpha=0$, the test charged particle remained loosely bound to charged sphere-1 for the duration of the calculation (about 400 oscillation cycles) roughly 50% of the time. The other 50% of the time the test charged particle was bound to neither charged sphere, and was knocked into a trajectory that tracked neither of them due to the combined interaction with both spheres at the beginning of the injection process.

Thus to summarize, for $\alpha>0$, the test charged particle is equally likely to either be tightly trapped by its own species, or by a bunch comprised of an adjacent species. For $\alpha=0$, the test charged particle is loosely trapped about 50% of the time by its own species, or not trapped at all.

In order to self-trap only the same species of charged particle, the ramped mirror fields as described above can be employed. In a specific embodiment, this consists of an initial period of time, $\Delta T \geqq T_0$, where the mirror potentials are held in a configuration yielding $\alpha=0$ while the charged particle species spatially separate due to their different velocities and relatively weak self-trapping fields. Then, the potentials are slowly changed in a fashion linearly-dependent on time to some fixed value of $\alpha$, which is a period during which the self-trapping forces become much stronger. After this prescribed ramping period, $\alpha$ is held fixed and the bunches of identical charged particles are continuously self-focused into tight self-sustaining bunches for the remainder of the trapping time, which is the time during which the FT-MS measurements are performed.

The required initial length of time, $T_0$, with $\alpha=0$ to have the m=4000 and m=4001 separate by the diameter of the charged spheres is given by Equation (9), and corresponds to about 4 milliseconds for the parameters specified above. This corresponds to about M=70 complete oscillation cycles for the 4000 amu charged particles. Additionally, to ensure that the different charged particle species are not given different energy shifts due to the changing fields, the ramping potential is assumed to be linear in time and chosen to occur over N=400 complete oscillation cycles.

Simulations were performed to verify the efficacy of this method for mitigating the effects of IBC.

It was found that applying the potential for M=70 oscillation cycles, and then applying the linear potential ramp over N=400 oscillation cycles up to an $\alpha$ of anywhere from 0.1 to 0.8, caused the test charged particle to be trapped roughly 50% of the time by the first charged sphere, and only about 20% of the time by the second charged sphere. If the initial period of $\alpha=0$ is increased to about M=150 oscillation cycles, and the linear potential ramp is applied over N=400 oscillation cycles up to an $\alpha$ of anywhere from 0.1 to 0.8, the test charged particle is trapped roughly 50% of the time by the first charged sphere, and only about 1-2% of the time by the second charged sphere. This constitutes a clear embodiment of the techniques and the efficiency of these techniques in minimizing the effects of IBC in a LIT FT-MS. In general, the initial period of time $\Delta T$ should be greater than M=1 cycles of oscillation of the slowest charged particles in the charged particle trap, and it is beneficial if M>10, and in some embodiments it is even more beneficial if M is about 100. Meanwhile, in general it is beneficial if the linear potential ramp is applied over N≧100 cycles of oscillation of the slowest charged particles in the charged particle trap, and in some embodiments it is even more beneficial if N is about 400.

It should be mentioned that the trapping percentages mentioned above are not to be interpreted as the expected trapping percentages in a physical LIT. For the simulations performed, the relative trapping percentages of the two charged spheres (one with the same mass-to-charge ratio as the test charged particle, and one different but close to it) reflect the relative self-trapping tendencies of a charge cloud on its prospective constituent charged particles. The self-trapping process of a bunch of charged particles is highly non-linear, and any preference for one process over another is highly amplified during the self-formation of the individual bunches. As a result, it is expected that this newly presented idea for IBC mitigation should be even more efficient than the numbers obtained in this rather simple set of simulations.

While example embodiments are disclosed herein, one of ordinary skill in the art appreciates that many variations that are in accordance with the present teachings are possible and remain within the scope of the appended claims. The embodiments therefore are not to be restricted except within the scope of the appended claims.

The invention claimed is:

1. A method of trapping a plurality of charged particles in a charged particle trap including first and second electrode mirrors arranged along an axis at opposite ends of the particle trap, the electrode mirrors being capable, when voltage is applied thereto, of creating respective electric fields configured to reflect charged particles causing oscillation of the particles between the mirrors, said method comprising the steps of:

(a) introducing into the charged particle trap the plurality of charged particles, the particles having a spread in the oscillation time of the particles per oscillation;

(b) applying voltage to the first and second electrode mirrors during step (a) to induce a relatively weak self-bunching of the charged particles; and (c) after the plurality of charged particles has been introduced into the charged particle trap, waiting for a time period $\Delta T$ and then after the time period $\Delta T$ has expired, changing the voltage applied to the first and second electrode mirrors so as to induce a relatively stronger self-bunching among the charged particles.

2. The method of claim 1, where $\Delta T$ corresponds to M cycles of oscillation of the slowest charged particles in the charged particle trap, where M>1.

3. The method of claim 1, wherein the voltage is changed over a period corresponding to N cycles of oscillation of the slowest charged particles in the charged particle trap, where N>1.

4. The method of claim 3, wherein M is about 100.

5. The method of claim 3, wherein M is at least 10.

6. The method of claim 3, wherein N≧100.

7. The method of claim 3, wherein N is about 400.

8. The method of claim 1, wherein the step of changing the voltage comprises continuously decreasing the voltage linearly over a period of time.

9. The method of claim 1, wherein the voltage produces a potential distribution, V(z), along the axis at a distance z from a midpoint between the first and second electrode mirrors:

$$V(z) = \begin{cases} 0 & \text{if } |z| \le L/2 \\ \Im(|z| - L/2) & \text{if } |z| > L/2 \end{cases}$$

where $$\Im = \frac{K(1-\alpha)}{(1+\alpha)},$$

and where K is a selected value, and wherein changing the voltage applied to the first and second electrode mirrors comprises changing a value of $\alpha$.

10. The method of claim 9, wherein $\alpha$ is set to 0 during steps (a) and (b) and during the a time period $\Delta T$, and wherein changing the voltage applied to the first and second electrode mirrors so as to induce a relatively stronger self-bunching among the charged particles comprises increasing $\alpha$ to a value≦1.

11. A device, comprising:

first and second electrode mirrors disposed along an axis to define a charged particle trap, the charged particle trap being adapted to have charged particles introduced therein;

a charge-sensing element disposed between the first and second electrode mirrors to output a signal based on a net charge from charged particles in a vicinity thereof, and a voltage generator configured to apply voltage to the first and second electrode mirrors, wherein the voltage generator is configured to apply voltage to the first and second electrode mirrors to induce a relatively weak self-bunching of the charged particles when the charged particles are initially introduced into the charged particle trap and for a time period ΔT thereafter, and then after the period ΔT to change the voltage applied to the first and second electrode mirrors so as to induce a relatively stronger self-bunching among the charged particles.

12. The device of claim 11, where ΔT corresponds to M cycles of oscillation of the slowest charged particles in the charged particle trap, where M>1.

13. The device of claim 12, wherein M is at least 10.

14. The device of claim 12, wherein M is about 100.

15. The device of claim 11, wherein the voltage generator is adapted to change the voltage applied to the first and second electrode mirrors over a period corresponding to N cycles of oscillation of the slowest charged particles in the charged particle trap, where N>1.

16. The device of claim 15, wherein N≧100.

17. The device of claim 15, wherein N is about 400.

18. The device of claim 11, wherein the voltage generator is adapted to continuously decrease the voltage linearly over a period of time.

19. The device of claim 11, wherein the voltage produces a potential distribution, V(z), along the axis at a distance z from a midpoint between the first and second electrode mirrors:

$$V(z) = \begin{cases} 0 & \text{if } |z| \le L/2 \\ \mathfrak{I}(|z| - L/2) & \text{if } |z| > L/2 \end{cases}$$

where $$\mathfrak{I} = \frac{K(1-\alpha)}{(1+\alpha)},$$

and where K is a selected value.

20. The device of claim 19, wherein α is set to 0 during steps (a) and (b) and during the a time period ΔT, and wherein changing the voltage applied to the first and second electrode mirrors so as to induce a relatively stronger self-bunching among the charged particles comprises increasing α to a value≦1.

21. The device of claim 11, further comprising a controller adapted to control the voltage generator to change the voltage applied to the first and second electrode mirrors over a period corresponding to N cycles of oscillation of the slowest charged particles in the charged particle trap, where N>1.

22. The device of claim 21, wherein the controller is further adapted to control the introduction of the charged particles into the charged particle trap.

* * * * *

UNITED STATES PATENT AND TRADEMARK OFFICE

CERTIFICATE OF CORRECTION

PATENT NO. : 7,608,817 B2
APPLICATION NO. : 11/780667
DATED : October 27, 2009
INVENTOR(S) : Curt Alan Flory It is certified that error appears in the above-identified patent and that said Letters Patent is hereby corrected as shown below:

In column 14, line 65, in Claim 11, delete "thereof," and insert -- thereof; --, therefor.

In column 16, line 15, in Claim 20, after "the" delete "a".

Signed and Sealed this

Second Day of February, 2010

David J. Kappos

David J. Kappos
*Director of the United States Patent and Trademark Office*